United States Patent [19]

Jonnet

[11] 4,024,023

[45] May 17, 1977

[54] APPARATUS AND METHOD FOR TRANSFERRING HOT COKE TO A DRY COKE COOLER

[75] Inventor: Albert G. Jonnet, Oakdale, Pa.

[73] Assignee: Koppers Company, Inc., Pittsburgh, Pa.

[22] Filed: Feb. 13, 1976

[21] Appl. No.: 657,728

[52] U.S. Cl. ..... 201/39; 202/228; 214/19; 214/104

[51] Int. Cl.[2] ..... C10B 39/02; C10B 39/12

[58] Field of Search ..... 202/227, 228, 262; 201/39; 214/19, 104, 315, 629, 630

[56] References Cited

UNITED STATES PATENTS

| | | | |
|---|---|---|---|
| 771,899 | 10/1904 | Fehr | 214/104 |
| 1,263,985 | 4/1918 | Wrightson et al. | 214/19 |
| 1,446,960 | 2/1923 | Brendel | 202/228 X |
| 3,702,662 | 11/1972 | Davieau | 214/315 X |
| 3,728,230 | 4/1973 | Kemmetmueller | 202/228 X |
| 3,848,344 | 11/1974 | Kemmetmueller | 202/228 X |

FOREIGN PATENTS OR APPLICATIONS

| | | | |
|---|---|---|---|
| 192,182 | 2/1923 | United Kingdom | 201/39 |

*Primary Examiner*—Joseph Scovronek
*Assistant Examiner*—Arnold Turk
*Attorney, Agent, or Firm*—R. Lawrence Sahr; Oscar B. Brumback

[57] ABSTRACT

An inclined track adjacent a dry coke cooler includes a counterweighted and pivoted hot coke container hoist that coacts with a hot coke container to raise it to a level above the coke cooler and then to lower it onto the open top of the coke cooler. After the hot coke has been discharged into the coke cooler, the hot coke container is returned to the car on which it travels alongside a coke oven battery to receive coke pushed from an oven chamber.

9 Claims, 2 Drawing Figures

APPARATUS AND METHOD FOR TRANSFERRING HOT COKE TO A DRY COKE COOLER

BACKGROUND OF THE INVENTION

The present invention relates to coke ovens and, more particularly, to apparatus and method for transferring hot coke pushed from a coke over chamber into a receptacle to a dry coke cooler apparatus.

For many years it has been convenient to cool hot coke pushed from a coke oven chamber in a large receptacle into which cooling gases flow.

The process is denoted as dry coke cooling and it contrasts sharply with conventional wet coke quenching and cooling with water on a coke wharf or at a quenching station.

The prior art includes U.S. Pat. No. 3,728,230 which discloses a coke plant and method for operating the same wherein coke is cooled by dry-quenching with a gas. Hot coke is pushed from a coke over chamber into a receptacle, and the receptacle is conveyed to a hoisting device. The receptacle containing the hot coke is tipped, when it reaches the top of the hoist, and the hot coke gravitates into a dry coke cooler or bunker means. Thereafter the empty receptacle is lowered and it is returned to a hot coke car that moves to the next oven chamber from which hot coke is to be pushed.

The apparatus of U.S. Pat. No. 3,728,230 is very similar to a conventional "skip hoist" for charging materials into a blast furnace.

The applicant points out that the apparatus of the cited U.S. Pat. No. 3,728,230 does not show or suggest one or more of the features claimed in this application, which features are more particularly described hereinafter.

SUMMARY OF THE INVENTION

A hopper for receiving and holding hot coke pushed from a coke oven chamber is transferred from a quenching car to a hoist track. A lifting carriage engages the hopper and carries it up the inclined hoist track. At the top of the hoist track, a pivotable section swings the hopper and lifting carriage to a position above the open top of a dry coke cooler unit. A closure for the top of the dry coke cooler unit is removed as the top section of the hoist track pivots, and the closure unit is later replaced when the top section pivots back again. Thereafter, the hopper is lowered onto the top of the dry coke cooler unit and forms a seal therewith, at the same time the coke is discharged into the dry coke cooler unit. Thereafter, the hopper is raised from the dry coke cooler unit and returned to the starting position at which the lifting carriage first engaged the hopper.

A number of limit switches are used to control electrical circuits that control the operation of the lifting carriage, the pivoting of the top section of the hoist track, the removal and replacement of a closure on the dry coke cooler unit.

DETAILED DESCRIPTION

Figure 1:
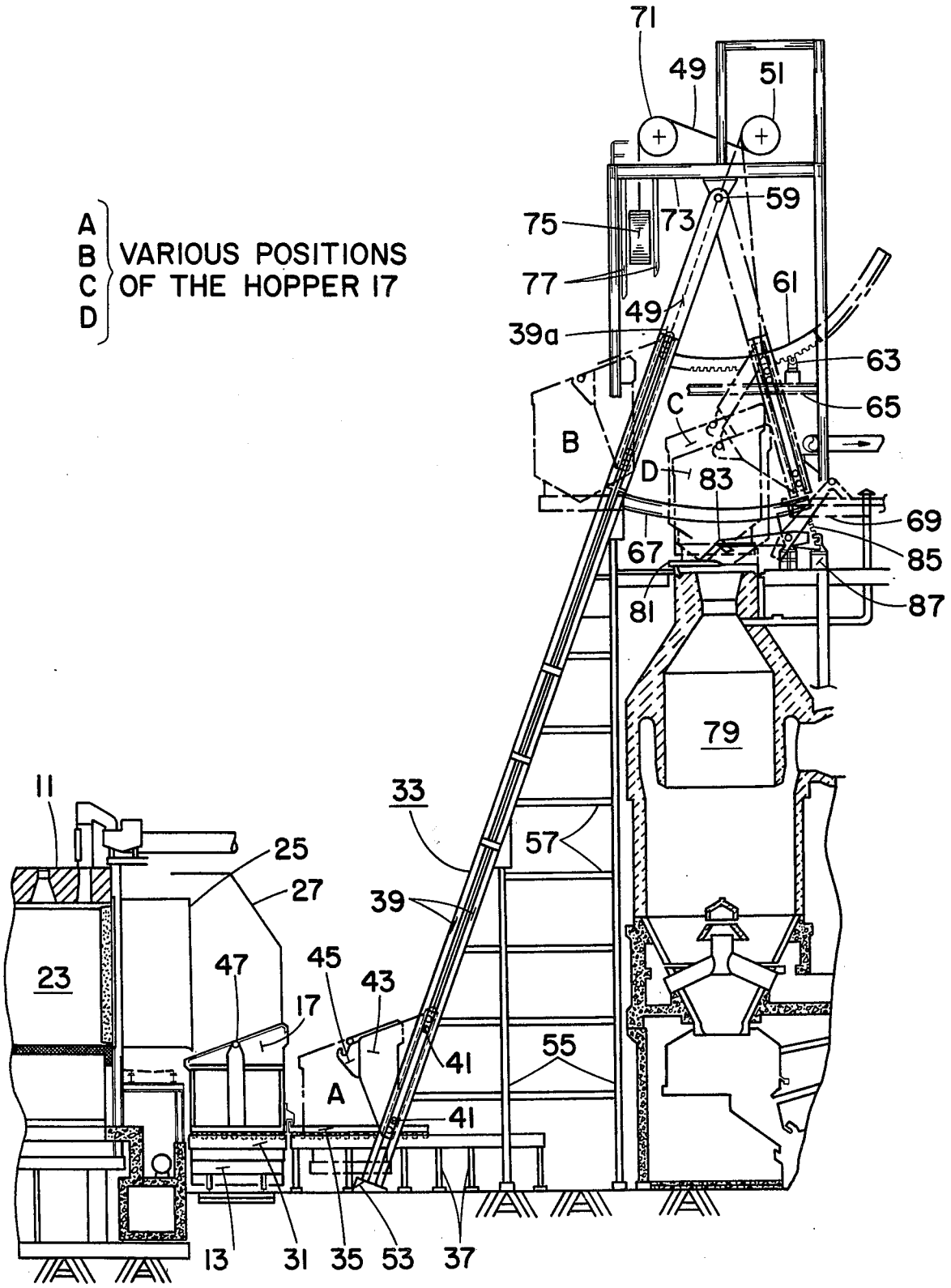
FIG. 1 is a schematic view of apparatus in accordance with the invention.

Referring to FIG. 1, a portion of a conventional coke oven battery 11 is associated with a coke quenching car 13 and a gas scrubbing car 15 (FIG. 2), with the coke quenching car 13 supporting a removable coke receiving hopper 17.

The gas scrubbing car 15 is conventional and includes a separator 19 into which gases flow through conduit 21 from the hopper 17 which receives hot coke pushed from a coke oven chamber 23 in the battery 11.

Figure 2:
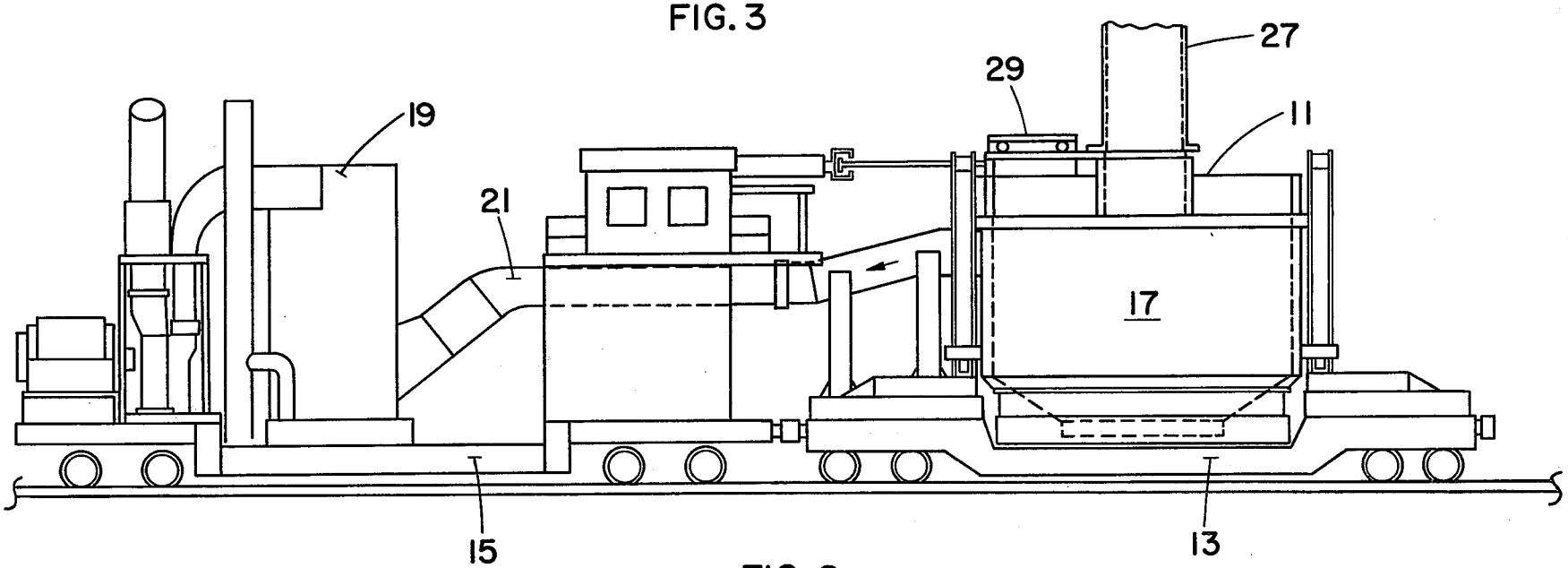
FIG. 2 is a schematic view of a portion of the apparatus of FIG. 1 in an elevational view.

The hot coke when pushed from the oven chamber 23 passes through a conventional coke guide 25 and through a hood 27 into the hopper 17. As shown in FIG. 2, the hopper 17 is fitted with a slidable closure plate 29 that is moved into position over the opening in the sloping top of the hopper 17 when the hood 27 is raised after all of the coke has been pushed from the chamber 23.

The hopper 17 is movable laterally from the car 13 on rollers 31 to a position A, as shown in FIG. 1, that is convenient to an inclined hoist track 33. The hopper 17 is movable laterally by a powered ram drive 35 and the hopper is supported on columnar structure 37, about as shown.

The hoist tract 33 comprises sloping rails 39 which cooperate with rollers 41 of a lifting carriage 43. The lifting carriage 43 has a pair of hooks 45 that coact with trunnions 47 mounted to the hopper 17 when the lifting carriage 43 is elevated on the rails 39 by a cable 49 wound onto the winch 51.

As noted in FIG. 1, the sloping rails 39 are supported at ground level by suitable footings 53 and otherwise by a suitable structural truss frame including columns 55 and horizontal girders 57.

The top portion 39*a* of the sloping rails 39 are pivoted as at 59, and the top portion 39*a* is provided with arcuate racks 61 which coact with powered pinions 63 mounted to supporting structure 65, about where shown in FIG. 1.

The lower end of the top portion 39*a* is guided when it pivots by arcuate guide bars 67 mounted to the sloping rails 39 at one end and to supporting structure 69 at the other end (right-hand end as viewed in FIG. 1). The arcuate guide bars 67 also serve as stops in the event the cables 49 should break, or that the winch 51 should slip and allow the lifting carriage 43 and the hopper 17 to drop.

As shown in FIG. 1, the cable 49 coacts with the powered winch 51 and the cable 49 also loops over a sheave 71 mounted to adjacent supporting structure 73 and is connected to a counterweight 75 disposed between vertical guides 77 so that it can freely move vertically when the lifting carriage 43 moves on the rails 39.

Figure 3:
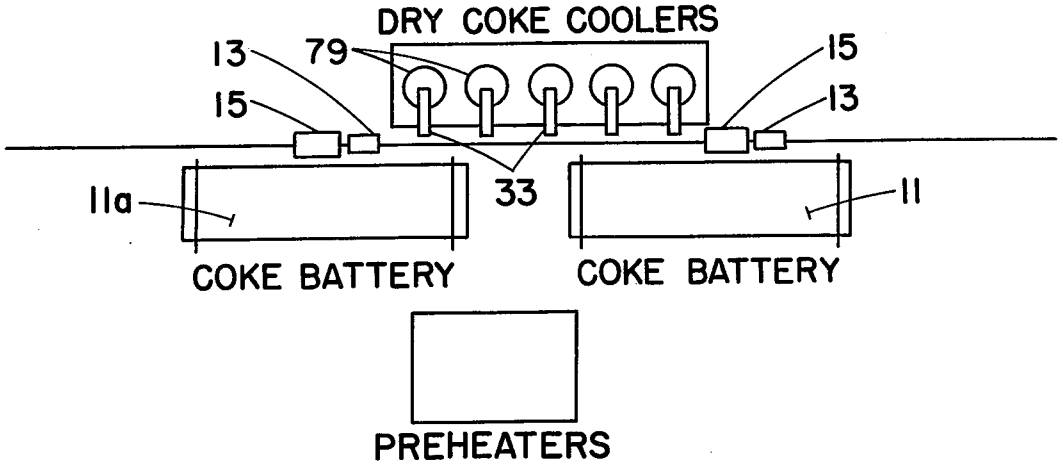
FIG. 3 is a schematic view of a plant facility showing where apparatus in accordance with the invention is located relative to other conventional apparatus.

The hoist track 33 is located, as shown in FIG. 1, adjacent to one of the five conventional dry coke cooler units 79 shown in FIG. 3 as being located adjacent to and between the two coke oven batteries 11, 11*a*. A hoist track 33, as shown schematically in FIG. 3, is disposed adjacent to each one of the dry coke cooler units 79.

Each dry coke cooler unit is conventional and is not described further herein, because those skilled in the art are familiar with such well-known dry coke cooler units like the Sulzer Brothers' unit and the like units.

The top of the dry coke cooker unit 79 is provided with a removable closure 81 that is carried by an arm 83 to which a quadrant 85 having gear teeth that coact with a powered pinion unit 87 is attached.

In operating a coke oven battery equipped with dry coke cooler units and other auxiliary apparatus (not shown) and with inclined hot coke container hoisting apparatus as shown and described herein, the coke quenching car 13 and gas cleaning car 15 are positioned at oven 23, which is to be pushed, so that the hot coke passes through the coke guide 25, and through the hood 27 into the hopper 17.

After the push is completed, the hood 27 is raised and the slidable cover 29 is positioned over the opening in the hopper 17.

The coke quenching car and gas cleaning car, which receives gases and fumes from the hot coke in the hopper 17, is moved to a location at one of the five dry coke cooler units 79. The hopper 17, as mentioned previously, is moved on the rollers 31 by the powered ram drive 35 from the car 13 to position A.

When the hopper 17 reaches the position A, it actuates a limit switch (not shown) that actuates the winch drive 51. The winch 51 moves the lifting carriage 43 initially at "creep speed" until the hooks 45 engage the trunnions 47 on the hopper 17. Thereafter, as the carriage and hopper move past another limit switch (not shown) the winch speed is increased to a maximum speed.

Before the hoisting carriage and hopper reach position B, another switch is actuated to energize the pinion drive 87 whereby the closure 81 is removed from the dry coke cooler unit.

When the lifting carriage and the hopper reach position B, another switch is actuated and the powered pinion 63 rotates so that the pivotable top portion 39*a* of the hoist track moves from the position shown in solid lines to the position shown in phantom lines in FIG. 1. The hopper moves then from position B to position C, above the dry coke cooler unit.

As the pivotable portion moves to the phantom line position, another switch is actuated that results in stopping the pinion drive 63, and also in actuating the hoist 51 to reverse at creep speed whereby the hopper moves downward from position C to position D.

As the hopper approaches position D, levers (not shown) on the bottom dump gates of the hopper engage stools on either side of the hopper, and the hopper gates open as the hopper seats on the top of the dry coke cooler unit and forms a suitable seal therewith.

As the hopper seats on the dry coke cooling unit, another switch is actuated and a timer is energized. The timer is set to a preselected time that the hopper remains seated on the dry coke cooler unit. When the preselected time period has elapsed and the hot coke in the hopper has been discharged into the dry coke cooler unit, the winch is again activated to lift the hopper and the lifting carriage from the dry coke cooler unit.

The hopper then returns to the position A by reversing the foregoing procedure. The hopper is held at position A until the quenching car and gas cleaning car return to the original position, and then the hopper is transferred from position A to the quenching car. That is to say, as soon as the hopper, loaded with hot coke, moves from the quenching car to position A, the gas cleaning car and the empty quenching car move to another hoist track, pick up a waiting hopper, transfer it onto the quenching car, and then proceed to the next oven to be pushed. Thus, it may be some time before the empty hopper, shown and described herein, is recalled and transferred to the coke quenching car.

From the foregoing description of one embodiment of the invention, those skilled in the art should recognize many important features and advantages of it, among which the following are particularly significant:

That the transportation of hot coke can easily be automated from the time it is pushed into the hopper until the hot coke is discharged into the dry coke cooler unit;

That each hoist track and cooler unit is independent of the others so that each unit can be taken out of service when it becomes necessary to inspect and maintain the hoist equipment; and That the hoist mechanism can be less costly than otherwise since the weight of the hopper with its hot cake and the lifting carriage are balanced by the counterweights, and that lower hoisting speeds are used which result in a saving over high speed hoisting cranes.

Although the invention has been described herein with a certain degree of particularity it is understood that the present disclosure has been made only as an example and that the scope of the invention is defined by what is hereinafter claimed.

What is claimed is:

1. In apparatus for transferring hot coke pushed from a coke oven chamber of a coke oven battery into a dry coke cooler receptacle having a removable top closure, the improvement comprising:

a. a car carrying a hopper thereon adapted to receive and hold hot coke discharged from said coke oven chamber;
b. means for moving said car alongside said battery;
c. means for moving said hopper off and away from said car and in a direction away from said battery;
d. a hoist track adjacent and upwardly inclined toward said dry coke cooler receptacle;
e. lifting means slidable on said track for coating with and supporting said hopper;
f. means for raising said lifting means and said hopper from a first position to a level above the top of said dry coke cooler receptacle;
g. means for pivoting a portion of said hoist track and said hopper to position said hopper above the top of said dry coke cooler receptacle;
h. means for removing said top closure on said dry coke cooler receptacle;
i. means for lowering said hopper onto the open top of said dry coke cooler receptacle;
j. means for discharging coke from said hopper into said dry coke cooler receptacle;
k. means for raising said hopper above said dry coke cooler receptacle;
l. means for replacing said top closure on said dry coke cooler receptacle;
m. means for pivoting the portion of said hoist track and said hopper to a position in alignment with the rest of said hoist track; and
n. means for lowering said hopper to said first position.

2. The invention of claim 1 wherein:

a. said means for pivoting a portion of said hoist track is a rack and power-driven pinion.

3. The invention of claim 1 wherein:

said means for removing and replacing the top closure of said dry coke cooler receptacle is an arm coupled to said top closure and powered means for actuating said arm.

4. The invention of claim 1 including:

a. a counterweight that balances the weight of said hopper and said lifting means.

5. In the method for transferring hot coke pushed from a coke oven chamber into a dry coke cooler receptacle, the improvement comprising the steps of:

a. pushing hot coke into a hopper;

b. transferring said hopper containing said hot coke from a first position adjacent said oven chamber to a second position adjacent said receptacle;

c. elevating said hopper along an upwardly inclined track having a pivotable top portion from said second position to a third position above the level of the top of said dry coke cooler receptacle;

d. pivoting said top portion of said track and said hopper from said third position to an intermediary position over said dry coke cooler receptacle;

e. lowering said hopper to a fourth position on said dry coke cooler receptacle;

f. discharging said coke from said hopper into said dry coke cooler receptacle;

g. raising said hopper from said dry coke cooler receptacle to said intermediary position;

h. pivoting said hopper from said intermediary position over said dry coke cooler receptacle to said third position;

i. lowering said hopper to said second position; and j. transferring said hopper to a new position adjacent another over chamber to be pushed.

6. Apparatus for transferring hot coke pushed from a coke oven chamber of a coke oven battery into a dry coke receptacle comprising:

a. a hoist track adjacent and upwardly inclined toward said dry coke cooler receptacle, said track having a fixed lower portion and a pivotable top portion;

b. coke carrying hopper means movable on said track from a first position at which coke is loaded into said hopper to a second position where said hopper is on the pivotable top portion of said track;

c. means for pivoting said top portion so as to position said hopper above said dry coke cooler receptacle;

d. means for lowering said hopper onto the top of said dry coke cooler receptacle;

e. means for discharging coke from said hopper into said dry coke cooler receptacle;

f. means for raising said hopper above said dry coke cooler receptacle;

g. means for pivoting said track into alignment with said fixed portion thereof; and h. means for lowering said hopper to said first position.

7. The invention of claim 6 including:

a. a removable top closure on said dry coke cooler receptacle; and b. means for removing and replacing said top closure.

8. The invention of claim 6 including:

a. counterweight means balancing the weight of said hopper and movable as said hopper moves.

9. The invention of claim 6 wherein:

a. said means for pivoting said portion of said hoist track is a rack and powered pinion.

* * * * *